United States Patent [19]

Healy

[11] 4,130,247

[45] Dec. 19, 1978

[54] SPRAY NOZZLE

[75] Inventor: Mark Healy, Orlando, Fla.

[73] Assignee: Senninger Irrigation, Inc., Orlando, Fla.

[21] Appl. No.: 751,900

[22] Filed: Dec. 17, 1976

[51] Int. Cl.[2] ..... B05B 1/26; B05B 1/30

[52] U.S. Cl. ..... 239/523; 239/396; 239/533.1; 239/570; 239/600

[58] Field of Search ..... 239/DIG. 19, 230, 390, 239/391, 521, 523, 550, 570, 600, 533.1, 396

[56] References Cited

U.S. PATENT DOCUMENTS

| | | | |
|---|---|---|---|
| 1,177,884 | 4/1916 | Molesta et al. | 239/523 |
| 1,764,570 | 6/1930 | Lohman | 239/523 X |
| 3,591,091 | 7/1971 | Galloway et al. | 239/523 |
| 3,669,356 | 6/1972 | Senninger | 239/230 |
| 3,697,002 | 10/1972 | Parkison | 239/570 X |
| 3,779,462 | 12/1973 | Bruninga | 239/390 X |
| 3,799,453 | 3/1974 | Hart | 239/391 X |

FOREIGN PATENT DOCUMENTS

| | | | |
|---|---|---|---|
| 163771 | 6/1955 | Australia | 239/391 |
| 638651 | 3/1962 | Canada | 239/550 |

*Primary Examiner*—Evon C. Blunk
*Assistant Examiner*—Andres Kashnikow
*Attorney, Agent, or Firm*—Duckworth, Hobby, Allen & Pettis

[57] ABSTRACT

A spray nozzle apparatus and a method of making a spray nozzle in which a variety of nozzle sizes can be made using several common components. The nozzle head has a threaded base for attachment to a water line which base has an opening passing therethrough for mounting removable nozzle inserts therein with retainer rings. A water-deflecting portion is removably mounted to the base so that a curved portion thereon will deflect water at a predetermined angle. The curved deflector is attached to the base with a single screw and a pair of positioning studs.

10 Claims, 3 Drawing Figures

SPRAY NOZZLE

BACKGROUND OF THE INVENTION

The present invention relates to spray nozzles and to methods of making spray nozzles and especially to a polymer spray nozzle having components to produce a range of nozzle sizes without having to produce molds for each particular size and shape.

In the past, a great variety of sprinklers have been utilized for watering or irrigation purposes, and typically, sprinkler heads are attached to water lines which may be under the earth or above the earth for directing the water from the water lines in a predetermined pattern to sprinkle an area of the earth's surface. One type of irrigation equipment that is becoming common has a central irrigation pipe connected to a central well and pump which is mounted on wheels and extends out across a field. The wheels may have electric motors or other means for moving the wheels to move the irrigation pipe, which is then rotated around a segment of a farm to irrigate a large area. The irrigation pipe typically would have sprinkler heads of some type attached to the top thereof, for spraying the water from the irrigation pipe as it moves over a circular area. Such irrigation pipes have used various types of sprinkler heads. One common type being a flat, spray nozzle such as illustrated in U.S. Pat. No. 2,503,671, to Wahlin, which teaches a flat spray nozzle made of brass, and molded into one piece for deflecting water in a flat spray pattern to cover an area being sprayed. This type of spray nozzle's principal advantage is in being simple and inexpensive when compared to more complex sprinklers, and accordingly, has fewer parts to malfunction. One problem with such sprinklers in irrigation systems is that the water being pumped through the irrigation pipes is not well filtered and contains small bits of sand and grit, which have been found to wear the brass surface at a rapid rate. The present invention is directed towards a spray nozzle producing a flat spray which is made of a polymer material and thus provides a surface which acts partially as a solid lubricant and having some small amount of resilience and which has been shown to outlast brass spray nozzles by as much as several times. One disadvantage of the spray nozzles such as taught in the Wahlin patent is that a great variety of nozzles having different orifices as well as a variety of curved, deflector surfaces requires a large inventory of sizes and models to provide the correct nozzle for different purposes and different sized systems. The present system is directed towards a spray nozzle that produces a flat spray, but which is made of a polymer and which is assembled from several components which can be adapted from other types of sprinkler components and has interchangeable parts in which different size orifices and different size curved deflector surfaces can be assembled to provide a variety of spray nozzles without having to have a large number of expensive molds and without having to supply a large number of different size nozzles to meet different requirements.

SUMMARY OF THE INVENTION

A spray nozzle head is provided having a threaded base for attachment to a water line, or the like, which has an opening therethrough and a series of bores extending into one end thereof. A removable nozzle insert is inserted in the opening through the threaded base and is sealed with an O-ring and locked with a retainer ring.

A removably mounted water deflector having a curved surface for deflecting water is mounted to the top of the base with a screw protruding into one of the bores extending therein, and the water deflector member has a pair of studs that protrude into additional bores for locking the water-deflector portion to the base. The same base may be used with the same water-deflector portion but with a variety of different sized, removable nozzle inserts adapted to fit into the opening through the base for making different sized openings. In addition, the water-deflector may be changed to provide different curvatures as desired, and the base is formed from a portion of a mold for a different type of sprinkler. Finally, the nozzle inserts, along with the retainer rings and a disc cap, are color-coded to indicate which size spray nozzle is being used. The spray nozzle is manufactured by molding the base member and inserting an O-ring into the base, and then a nozzle insert through the O-ring in the opening through the base, and then a retaining ring is inserted to lock the nozzle insert in place. The water-deflector portion has a pair of protruding studs inserted into position in a pair of bores in the top of the threaded base and a screw is threaded through a portion of the water-deflector member into a third bore in the base; and a disc cap is press-fitted in place to cover the water deflector member and hide the screw.

BRIEF DESCRIPTION OF THE DRAWINGS

Other objects, features and advantages of the present invention will be apparent from the written description and the drawings in which.

DESCRIPTION OF THE PREFERRED EMBODIMENT

Figure 1:
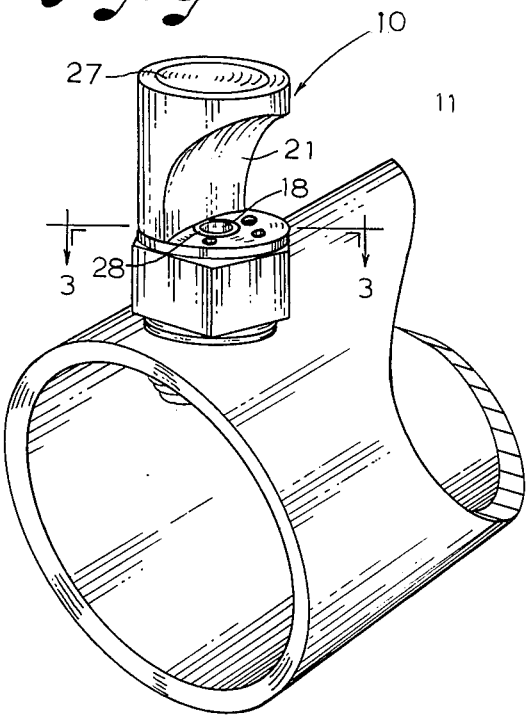
FIG. 1 is a perspective view of a spray nozzle head in accordance with the present invention attached to a water line.
Figure 2:
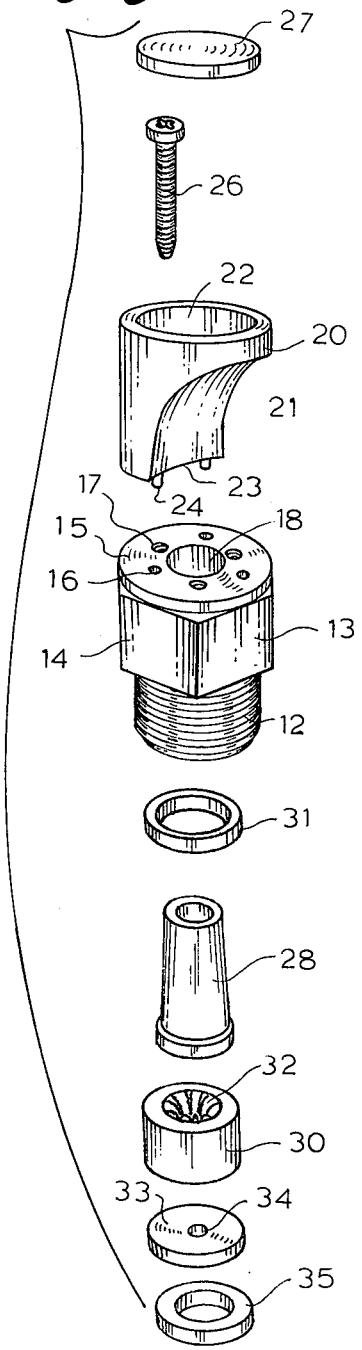
FIG. 2 is an exploded view of the sprinkler head of FIG. 1.
Figure 3:
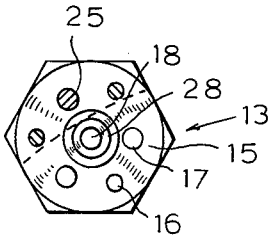
FIG. 3 is a sectional view taken on the line 3—3 of FIG. 1.

Referring now to the drawings, a spray nozzle head 10 is illustrated attached to a water line 11 by means of threads 12 as illustrated in FIG. 1. The nozzle head 10 has a threaded base 13 with the threads 12 protruding through one end thereof and a hexhead surface 14 for allowing the base to be threaded into a water line 11. Base 13 has a top portion 15 having a plurality of small holes 16 and a plurality of slightly larger holes 17 therein with one large center hole 18 passing through the base member 13. The base member 13 is adapted to have a water deflecting member 20 attached thereto. The water-deflecting member has a curved water deflecting surface 21 and is open from the top through an opening 22. The bottom of the deflector 23 has a pair of protruding studs 24 molded thereinto, at predetermined locations to match at least one pair of openings 16 in the base 13. The deflector portion 20 also has an opening 25 passing from inside the open portion 22 for a screw 26 to pass through and to be self-threaded into one of the openings 17 located between the opening 16 that the studs 24 have been positioned in. The studs 24 and the screw 26 together, lock the member 20 in place onto the threaded base 13. Once the water-deflector 20 is locked in place, a disc cap 27 can be pressure-fitted in the opening 22 to conceal the screw 26. The disc 27 may have a number of illustrated in the top thereof, and may be color-coded to indicate the particular size spray nozzle. In addition, a nozzle insert 28 and a retainer ring 30 may be color-coded the same as the disc 27 so that the correct components are used together to indicate the proper nozzle, both during assembly and during use. An O-ring 31 is inserted into the bottom opening of the base 13, onto a ledge located therein and the nozzle insert 28 is inserted into the opening 18. The opening 18 is cone-shaped to exactly receive the nozzle 28, and a plurality of different sized nozzles 28 may be utilized, each having a different color code, but each having the same exterior diameter, with a different interior passageway.

The inserting of the nozzle insert 28 changes the interior passageway, and thereby the velocity and path of the water passing therethrough. The retainer rings 30 are press-fitted into the opening through the threaded portion 12 of the space 13 to lock the nozzle insert 28 in place and may have vanes 32 therein, and similarly, may be color-coded to assure that the same color is utilized for the nozzle insert 28, retainer ring 30, and the disc cap 27. The base 13 and the water-deflector 20 may be black, molded plastic, while the nozzle insert 28, retainer ring 30, and disc cap 27 may be orange, blue, brown or any color desired; and each disc cap 27 may have a number to indicate the specific size of spray nozzle. It should also be clear at this point that the water-deflector portion 20 can have the studs 24 fit in any pair of openings 16 so that the model illustrated can be put in three different positions and the screw 26 threaded into the bore between the two openings 16 in that the studs 24 have been placed in.

A flow control or restriction member 33 may have a small opening 34 therethrough and may be held adjacent the retainer ring 30 in the passageway 18 of the hose 13 by a separate retainer ring 35. The flow control member 33 cuts back on the water that goes through the spray nozzle regardless of pressure and may be of a flexible material so that increased pressure pulls the center around opening 34 in the retainer 30 against the vanes 32 to narrow the passageway therethrough. This allows a flow controller to be quickly and inexpensively incorporated into the spray head rather than using a separate housing.

One advantage of the present invention is that the nozzle inserts 28 can be used from nozzle inserts utilized in other sprinklers, such as those illustrated in U.S. Pat. No. 3,669,356 to Senninger, along with standard inserts 30 and standard O-rings 31. The base member 13 can be made in existing molds by blocking off a portion of a mold for other sprinklers while the bores 16 and 17 can be used in the cooling of the parts during molding. Thus, a wide variety of sizes can be provided by the use of existing molds and then providing a simple mold for the making of a water-deflector portion 20 and disc 27. The screws 26 may be stainless steel and the entire spray nozzle may be made of a polymer material, and is readily molded in injection molding machines. The color-coding of the parts 28, 30 and 27, along with the numbering on the disc 27, allows for the ready assemblage and identification of the size of each spray head and the plurality of bores 16 and 17, allow cooling of the molded part, but also allow a water-deflector 20 to be placed in different holes should the screw, for any reason, loosen in the opening that it is originally attached to. The present invention is, however, not to be construed as limited to the particular forms disclosed herein, which are to be regarded as illustrative rather than restrictive.

I claim:

1. A spray nozzle comprising in combination:

a threaded base for attachment to a water line, and having an opening therethrough and a plurality of bores therein;

a removable nozzle insert mounted in said opening through said base with a retainer ring and having an opening therethrough of a predetermined size, and an exterior of predetermined size and shape for fitting into the opening through the threaded base;

a removably mounted water-deflector member, having a curved water deflecting surface and having attaching means for attaching said water-deflector to said base, said attaching means having at least one insert attached to said water-deflector member and protruding into one of said plurality of bores in said threaded base, whereby an easily assembled spray nozzle is provided; and a flow control member mounted adjacent said removable nozzle insert retainer ring in said opening in said threaded base, said flow control member being a flexible member which under increased pressure is flexed into said nozzle insert retainer ring to reduce the passageway through said retainer ring.

2. The apparatus in accordance with claim 1, in which said removable nozzle insert is positioned over an O-ring for sealing said nozzle insert in said threaded base.

3. The apparatus in accordance with claim 2, in which said threaded base removable nozzle insert and removably mounted water deflector member are formed of a polymer material.

4. The apparatus in accordance with claim 3, in which said threaded base and said removably mounted water-deflector are of one color and said nozzle insert and retainer ring are of a second size, identifying color.

5. The apparatus in accordance with claim 4, in which said removably mounted water-deflector member has an open top covered with a disc-shaped cap.

6. The apparatus in accordance with claim 5, in which said disc cap is color coded the same color as said removable nozzle insert and retainer ring, and has an identifying number molded therein.

7. The method of making a spray nozzle comprising the steps of:

molding a threaded base having an opening therethrough and a plurality of bores extending into one end thereof;

inserting a nozzle insert of predetermined size in said opening through said threaded base;

locking said nozzle insert in said threaded base with a retainer ring press-fitted thereover;

molding a water-deflector of predetermined shape, including the molding of said water-deflector with a pair of protruding studs positioned in a predetermined position for inserting into a pair of said bores in said threaded base, and screwing a threaded member through said curved deflector member into a third bore in said base; and attaching said molded water-deflector to said base.

8. The method in accordance with claim 7, including the step of pressure-fitting a disc cover over the top of said water deflector member.

9. The method in accordance with claim 7, including the step of inserting an O-ring in said opening through said base prior to inserting said nozzle insert for sealing said nozzle insert in said opening through said base.

10. The method in accordance with claim 9, in which a color coded disc retainer ring and nozzle insert are assembled onto said water deflector member for indicating the size of the nozzle insert inserted into said base.

* * * * *